US008380264B2

(12) United States Patent
Hung et al.

(10) Patent No.: US 8,380,264 B2
(45) Date of Patent: Feb. 19, 2013

(54) CASE FOR ELECTRICAL DEVICE AND METHOD OF PROVIDING SAME

(75) Inventors: Juliana S. Hung, Arcadia, CA (US); Xin Fu, Luo Hu (CN); Takuya Idehara, Los Angeles, CA (US); Henry Law, Orange, CA (US)

(73) Assignee: Belkin International, Inc., Playa Vista, CA (US)

( * ) Notice: Subject to any disclaimer, the term of this patent is extended or adjusted under 35 U.S.C. 154(b) by 404 days.

(21) Appl. No.: 12/852,448

(22) Filed: Aug. 6, 2010

(65) Prior Publication Data

US 2011/0034221 A1 Feb. 10, 2011

Related U.S. Application Data

(60) Provisional application No. 61/232,002, filed on Aug. 6, 2009.

(51) Int. Cl.
*H04M 1/00* (2006.01)

(52) U.S. Cl. ..... 455/575.8; 224/580

(58) Field of Classification Search ..... 455/575.8, 455/128

See application file for complete search history.

(56) References Cited

U.S. PATENT DOCUMENTS

| | | | | |
|---|---|---|---|---|
| 6,279,804 | B1 | 8/2001 | Gregg | |
| 2001/0029170 | A1 | 10/2001 | Fujihashi | |
| 2004/0206796 | A1 | 10/2004 | Badillo et al. | |
| 2006/0052064 | A1 | 3/2006 | Goradesky | |
| 2006/0172765 | A1 | 8/2006 | Lev | |
| 2007/0259704 | A1 * | 11/2007 | Jung | 455/575.8 |
| 2007/0293288 | A1 * | 12/2007 | Lin et al. | 455/575.8 |

OTHER PUBLICATIONS

International Search Report from corresponding application No. PCT/US10/44816 filed Aug. 6, 2009, 11 pages.

* cited by examiner

*Primary Examiner* — Tu X Nguyen
(74) *Attorney, Agent, or Firm* — Bryan Cave LLP

(57) ABSTRACT

In some examples, a mobile media device case can include: (a) an enclosure with a cavity, the cavity sized to contain a mobile media device therein, the enclosure further having: (1) a top side; (2) a bottom side, the bottom side configured to receive the mobile media device; (3) a front side, the front side is configured to allow visual and tactile access to the mobile media device when the mobile media device is in the cavity; and (4) a back side. Other embodiments and related methods are also disclosed herein.

20 Claims, 14 Drawing Sheets

CASE FOR ELECTRICAL DEVICE AND METHOD OF PROVIDING SAME

CROSS REFERENCE TO RELATED APPLICATION

This application claims priority to U.S. Provisional Patent Application 61/232,002 filed on Aug. 6, 2009, the contents of which are incorporated herein by reference.

FIELD OF THE INVENTION

This invention relates generally to cases for electrical devices, and relates more particularly to such cases that provide easy access to and protection of electrical devices and methods of using the same.

BACKGROUND

The portable media player and cellar telephone market has changed dramatically in the past several years and with it, the portable media player or cellular telephone case or enclosure market. Recent trends have focused on the emergence of the smart devices, which simply put is a handheld phone or media player incorporating several additional features not found in traditional handheld phones or media players.

Smart devices can include one or more of the following features: the merging of a personal data/digital assistant (PDA) and a cellular phone; a keyboard interface (e.g., a QWERTY keyboard) configuration as either a touch screen or tactile keyboard; the capability to receive/download and view audio/video files. Furthermore, smart devices can: run an operating system software providing a standardized interface and platform for application developers; include advanced features like e-mail, Internet access and e-book reader capability; and/or include a built-in full keyboard or external USB keyboard and VGA connector. In other words, smart devices can be considered a miniature computer that can have telephone capability. One example of a smart devices is the iPhone® product by Apple Inc. of Cupertino, Calif. Another example of smart devices is the Blackberry® product by Research In Motion (RIM) of Waterloo, Ontario, Canada.

Following the introduction of smart devices, smart devices cases were introduced. Unfortunately, there are many shortcomings to current smart device case designs. One such shortcoming is lack of ability to easy view image and video on the smart devices when the smart devices are in the case. While it is possible to view the images or videos while holding such video-capable smart devices in one's hand, it would often be more convenient and more comfortable to set down the smart devices and have them maintain a position in which the images and videos can be viewed easily.

Furthermore, most smart devices include display screens, touch screens and/or control mechanisms. It would be convenient for the user of such smart devices if a protective case allowed easy viewing of the display screen from a distance and operation of smart devices, without requiring the user to hold the smart devices or remove it from the case.

Accordingly, a need exists for a case for an electrical device that both protects the electrical device and allows it to maintain a hands-free operating and viewing position.

BRIEF DESCRIPTION OF THE DRAWINGS

The invention will be better understood from a reading of the following detailed description of examples of embodiments, taken in conjunction with the accompanying figures in the drawings in which.

Figure 1:
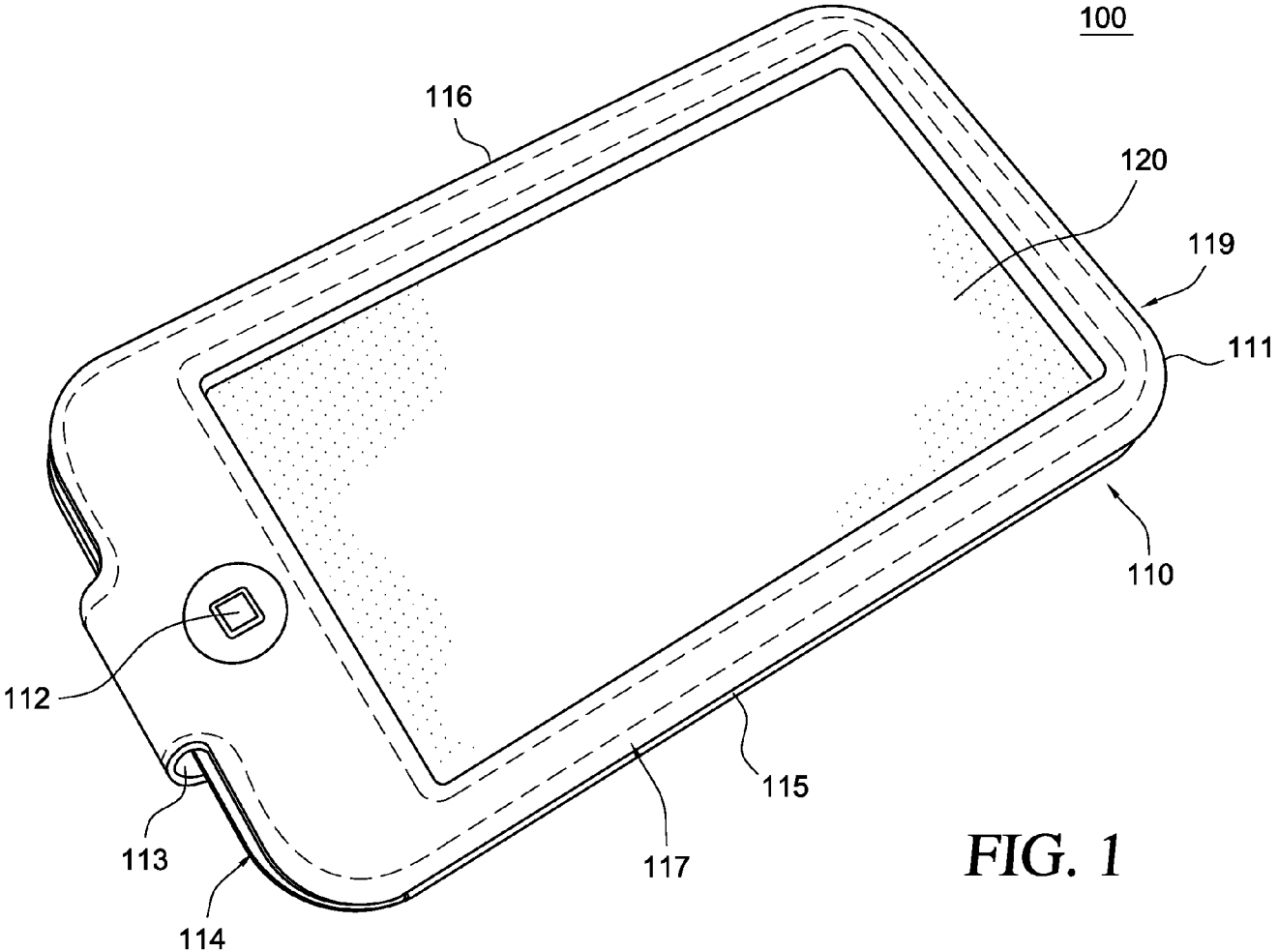
FIG. 1 is a front perspective view illustrating an embodiment of an exemplary mobile media device case, according to a first embodiment.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

The terms "couple," "coupled," "couples," "coupling," and the like should be broadly understood and refer to connecting two or more elements or signals, electrically, mechanically or otherwise. Two or more electrical elements may be electrically coupled, but not mechanically or otherwise coupled; two or more mechanical elements may be mechanically coupled, but not electrically or otherwise coupled; two or more electrical elements may be mechanically coupled, but not electrically or otherwise coupled. Coupling (whether mechanical, electrical, or otherwise) may be for any length of time, e.g., permanent or semi-permanent or only for an instant.

"Electrical coupling" and the like should be broadly understood and include coupling involving any electrical signal, whether a power signal, a data signal, and/or other types or combinations of electrical signals. "Mechanical coupling" and the like should be broadly understood and include mechanical coupling of all types. The absence of the word "removably," "removable," and the like near the word "coupled," and the like does not mean that the coupling, etc. in question is or is not removable. As used herein, "electrical device," smart device," and "mobile media device" can be used interchangeably and refer to an electrical device that can utilize the features of the mobile media cases described herein.

DETAILED DESCRIPTION

In some examples, a mobile media device case can include: (a) an enclosure with a cavity, the cavity sized to contain a mobile media device therein, the enclosure further having: (1) a top side; (2) a bottom side, the bottom side configured to receive the mobile media device; (3) a front side, the front side is configured to allow visual and tactile access to the mobile media device when the mobile media device is in the cavity; and (4) a back side, the back side having: (i) a first case back layer configured to be in mechanical communication with the top side and the bottom side of the enclosure; and (ii) a second case back layer including a positioning strap opening; (b) a positioning strap having: (1) a first positioning strap edge, the first positioning strap edge elastically coupled between the first case back layer and the second case back layer; (2) a second positioning strap edge, the second positioning strap edge fixedly coupled between the first case back layer and the second case back layer; (3) a top surface located between the first positioning strap edge and the second positioning strap edge; and (4) a bottom surface opposite the top surface and located between the first positioning strap edge and the second positioning strap edge. Two or more positioning strap openings can be located between an edge of the first case back layer of the back side and an edge of the second case back layer of the back side. The enclosure can be configured such that when force is applied to the positioning strap, the positioning strap is configured to deform in a substantially perpendicular direction away from the first case back layer, the first positioning strap edge of the positioning strap is configured to abut an edge of a first one of the two or more positioning strap opening, and the second positioning strap edge of the positioning strap is configured to abut an edge of a second one of the two or more positioning strap opening.

Other examples concern a mobile media device case to hold a mobile media device. The mobile media device case can include: (a) three or more sides defining a media device cavity, the media device cavity configured to hold the mobile media device; (b) a positioning strap coupled to a first side of the three or more sides, the positioning strap comprising at least four surfaces; (c) a first elastic securing portion coupled to a first surface of the at least four surfaces of the positioning strap and the first side of the three or more sides; and (d) a second elastic securing portion coupled to a second surface of the at least four surfaces of the positioning strap and the first side of the three or more sides. The positioning strap can be configured to move between a non-deployed state and a deployed state. The positioning strap and the first side of the three or more sides can be configured such that when the positioning strap is in the non-deployed state, at least part of a third surface of the at least four surfaces of the positioning strap is abutting the first side of the three of more sides. The positioning strap and the first side of the three or more sides can be configured such that when the positioning strap is in the deployed state, the positioning strap is in a curvilinear position such that at least part of the first surface of the at least four surfaces of the positioning strap and at least part of the second surface of the at least four surfaces of the positioning strap are abutting the first side of the three or more sides and at least part of a third surface and at least part of a fourth surface of the at least four surfaces of the positioning strap are spaced apart from the first side of the three or more sides.

Yet further embodiments can concern a method of using a media case. Thee method can include: providing the media case to include: (a) three or more sides defining a media cavity, the media cavity configured to contain a mobile media device; (b) a positioning strap, the positioning strap coupled to a first side of the three or more sides, the positioning strap having at least four edges, the first edge of the at least four edges and the second edge of the at least four edges of the positioning strap are elastically coupled to the first side of the three or more sides; gripping at least one of a third edge of the at least four edges of the positioning strap or a fourth edge of the at least four edges of the positioning strap; applying a force to the positioning strap such that at least a portion of the positioning strap extends away from the first side of the three or more sides; and resting the at least a portion of the positioning strap and a second side of the three or more sides on a surface.

FIG. 1 illustrates a front perspective view of an embodiment of apparatus for providing protection of an electrical device or a mobile media device or an exemplary mobile media device case 110, according to the first embodiment. Mobile media device case 110 is merely exemplary and is not limited to the embodiments presented herein. Mobile media device case 110 can be employed in many different embodiments or examples not specifically depicted or described herein.

Figure 3:
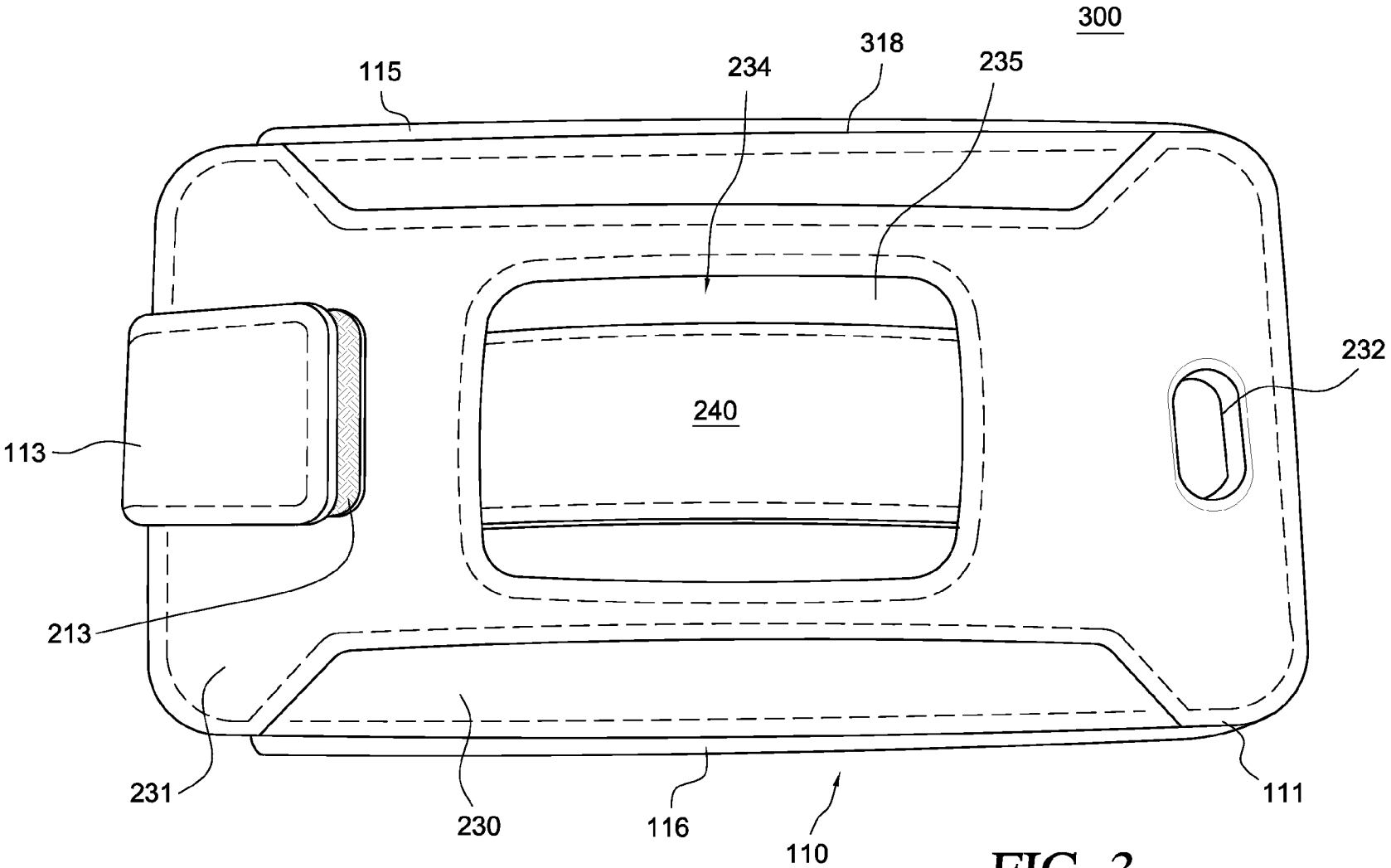
FIG. 3 is a top-down rear view of the mobile media device case of FIG. 1 with the positioning strap of FIG. 2 not deployed, according to the first embodiment.

FIG. 1 includes a mobile media device case system 100 that includes a mobile media device case 110. An apparatus for providing protection of an electrical device or mobile media device case 110 can include: (a) media device enclosure 111; (b) hardware interface portion 112; (c) securing strap 113; (d) media device opening 114; (e) right side 115; (f) left side 116; (g) front 117; (h) a back side 318 (FIG. 3); (i) a bottom side 119; and (j) media device cavity 120. FIG. 1 may include additional elements not relevant to the present discussion.

In some embodiments, media device enclosure 111 is configured to receive an electrical device or a mobile media device within media device cavity 120. In these embodiments, media device cavity 120 can be defined by media device enclosure 111 on three sides (e.g., left side 116, right side 115 and a back/rear) with the fourth side (e.g., front 117) partially open to allow visual and tactile access to portions of the screen of the mobile media device (not shown). In other embodiments (not shown), media device cavity 120 is defined at least partially by media device enclosure 111 on three sides (e.g., left side 116, right side 115 and a back/rear) with the fourth side enclosed using a transparent material, such as, for example a transparent polymer to allow visual and tactile physically protected access to the screen of the mobile media device.

In still other embodiments, right side 115 and left side 116 can be manufactured at least in part from partially elastic materials allowing mobile media device case 110 to securely enclose the mobile media device. In such embodiments, because right side 115 and left side 116 are manufactured at least in part from partially elastic materials, the front 117 and back portion of media device enclosure 111 can collapse upon one another when not in use, thereby requiring less space for storage of mobile media device case 110.

In some embodiments, media device enclosure 111 forms media device cavity 120. Media device enclosure 111 includes media device opening 114 along one of the ends (e.g., the bottom) of media device enclosure 111. This opening allows the mobile media device (not shown) to be placed into and removed from media device cavity 120. Furthermore, in some embodiments, media device opening 114 is configured to be closable and can be closed and secured by securing strap 113.

Figure 2:
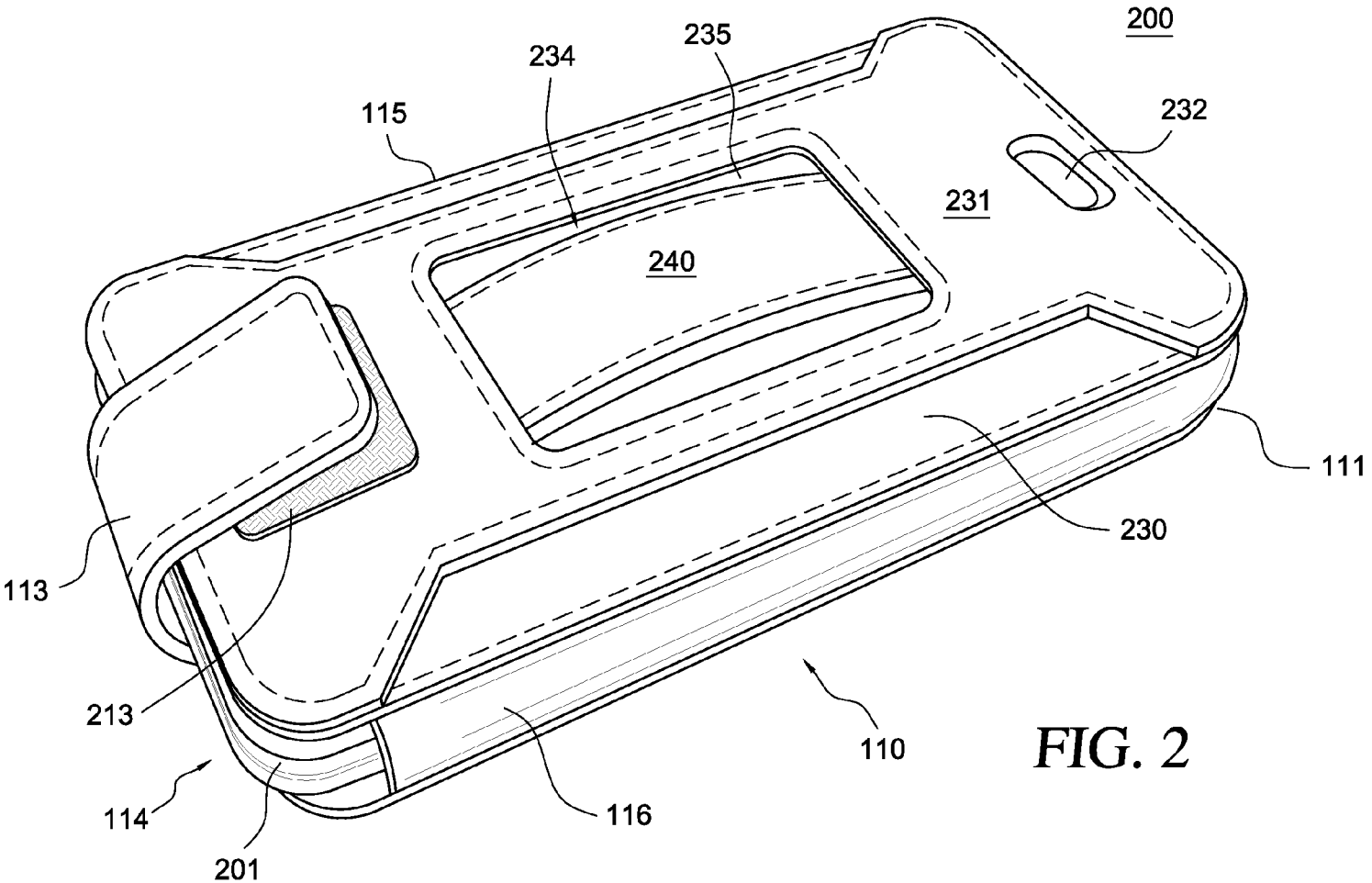
FIG. 2 is a rear perspective view of the mobile media device case of FIG. 1 with a positioning strap not deployed, according to the first embodiment.

FIG. 2 is a rear perspective view of the mobile media device case 110 with a positioning strap 240 not deployed, according to the first embodiment. FIG. 3 is a top-down rear view of the mobile media device case 110 with the positioning strap 240 not deployed, according to the first embodiment. FIG. 2 includes mobile media device case system 200 that includes mobile media device case 110. FIG. 3 includes mobile media device case system 300 that includes mobile media device case 110. In FIGS. 2 and 3, elements numbered as in FIG. 1 perform in a substantially similar way. In some examples, mobile media device case system 200 can be similar or identical to mobile media device case system 300 and mobile media device case system 100.

Referring to FIGS. 2 and 3, mobile media device case 110 can additionally include: (a) securing strap receiving layer 213; (b) first case back layer 230; (c) second case back layer 231; (d) camera well opening 232; (e) one or more positioning strap opening 234; (f) positioning strap cavity 235; and (g) positioning strap 240. Mobile media device case 110 can be configured to hold mobile media device 201.

In the same or different embodiments, media device enclosure 111 includes a multilayer back portion having first case back layer 230 that includes camera well opening 232.

In some embodiments, media device enclosure 111 is configured to receive mobile media device 201 within the media device cavity. Mobile media device 201 can be secured inside media device cavity 120 by securing strap 113 to securing strap receiving layer 213. In some examples, securing strap 113 is releasably securable to securing strap receiving layer 213. In one embodiment, securing strap 113 and securing strap receiving layer 213 are complementary Velcro® material. In other embodiments, securing strap 113 and securing strap receiving layer 213 can be buttons, snaps string ties, or the like. In some examples, securing strap 113 and securing strap receiving layer 213 can also contain magnets to help align and couple securing strap 113 and securing strap receiving layer 213.

As will be described in detail below, positioning strap 240 can be designed and configured such that at least a portion of positioning strap 240 can be extended away from the mobile media device case 110 (i.e., deployed).

In some examples, positioning strap 240 can be composed of (or at least partially composed of) leather, PVC (polyvinyl chloride), TPU (thermoplastic polyurethane), plastic, nylon, neoprene, silicone, polyester, recycled plastic, rubber, metal, wood, wovens, knits, synthetic leather and wool/synthetic felt, PLA (polyactide), and/or paper.

In the same or different embodiments, mobile media device case 110 can be composed of leather, PVC, TPU, plastic, nylon, neoprene, silicone, polyester, recycled plastic, rubber, metal, wood, wovens, knits, synthetic leather and wool/synthetic felt, PLA, and/or paper. In still other embodiments, portions of mobile media device case 110 can be composed of one or more of the aforementioned materials while other portions of mobile media device case 110 can include one or more other aforementioned materials.

Figure 4:
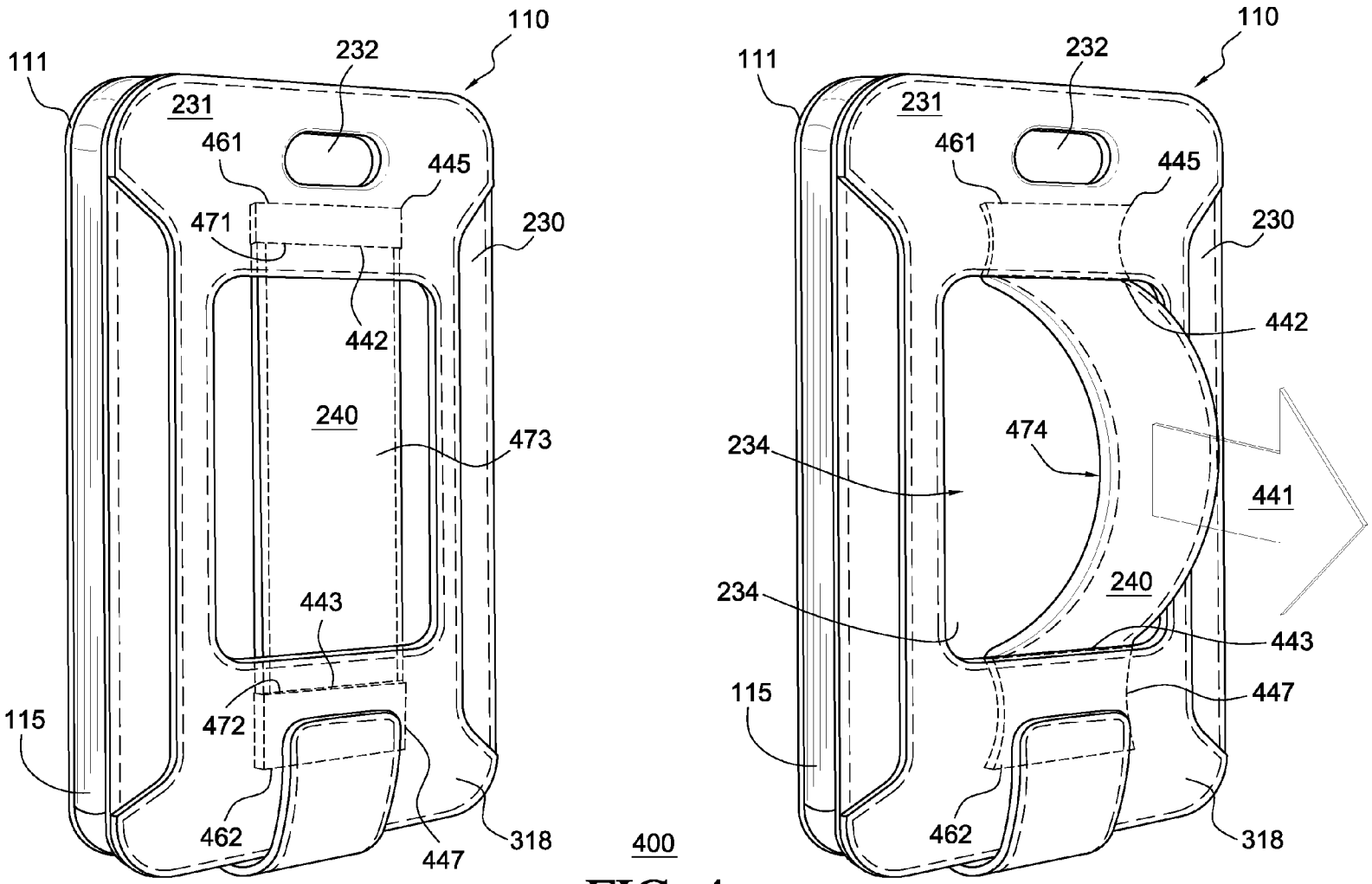
FIG. 4 is a rear perspective view illustrating the exemplary mobile media device case of FIG. 1 before and after deployment of the positioning strap of FIG. 2, according to the first embodiment.

FIG. 4 is a rear perspective view illustrating the exemplary mobile media device case 110 before and after deployment of the positioning strap 240, according to the first embodiment. FIG. 4 includes mobile media device case system 400 that two views of mobile media device case 110 in two configurations: mobile media device case with a non-deployed positioning strap 240 and dynamic mobile media device case with the positioning strap 240 deployed. In FIG. 4, elements numbered as in FIGS. 1-3 perform in a substantially similar way. Mobile media device case 110 can also be referred to as dynamic mobile media device case 110 when positioning strap 240 at least partially extends away from the rest of mobile media device case 110 as illustrated in FIG. 4. Positioning strap 240 can be referred to as dynamic positioning strap 240 when positioning strap 240 at least partially extends away from the rest of mobile media device case 110 as illustrated in FIG. 4.

Referring to FIG. 4, mobile media device case 110 can further include: (a) first positioning strap edge 442; (b) second positioning strap edge 443; (c) first elastic securing portion 445; and (d) second elastic securing portion 447. Positioning strap 240 can include: (a) a first edge 471; (b) a second edge 472; (c) a third edge 473; and (d) a forth edge 474.

FIG. 4 illustrates mobile media device case 110 in a non-deployed, secured, or closed state that includes positioning strap 240 secured to first case back layer 230 via first elastic securing portion 445 and second elastic securing portion 447. In some embodiments, first elastic securing portions 445 and 447 are configured as part of positioning strap 240 and secured to first case back layer 230 or second case back layer 231. In this example, first elastic securing portions 445 and 447 couple positioning strap 240 to first case back layer 230 and second case back layer 231. That is, first elastic securing portion 445 can be coupled to positioning strap 240 at first position strap edge 442 and coupled to first case back layer 230 or second case back layer at edge 461. Similarly, second elastic securing portion 447 can be coupled to positioning strap 240 at first position strap edge 443 and coupled to first case back layer 230 or second case back layer at edge 462. When in the secured or closed state, positioning strap 240 is not in use.

FIG. 4 also illustrates dynamic mobile media device case 110 in a deployed, dynamic, or open state. In the dynamic state, dynamic positioning strap 240 is positioned away from first case back layer 230 via first elastic securing portion 445 and second elastic securing portion 447. In some embodiments, first elastic securing portions 445 and second elastic securing portion 447 are configured as part of positioning strap 240 and are secured to first case back layer 230 and/or second case back layer 231. In some examples, positioning strap 240 is secured to first case back layer 230 via associated first positioning strap edge 442 and second positioning strap edge 443.

In operation, when a force is applied along a dynamic movement axis 441, positioning strap 240 can be moved into a curvilinear shape, and first positioning strap edge 442 contacts an associated portion of positioning strap opening 234, and second positioning strap edge 443 contacts another associated portion of positioning strap opening 234. In some examples, positioning strap opening 234 can be considered two or more openings.

Additionally, first elastic securing portion 445 is stretched to allow first positioning strap edge 442 to contact the associated portion of positioning strap opening 234. Similarly, second elastic securing portion 447 is stretched to allow second positioning strap edge 443 to contact the associated portion of positioning strap opening 234. In various embodiments, when stretched, first elastic securing portion 445 and second elastic securing portion 447 can have the hourglass shapes shown in FIG. 4 because the edges of first elastic securing portion 445 and second elastic securing portion 447 are coupled to edges 442 and 461 and edges 443 and 462, respectively. In other embodiments, only one of the edges of dynamic positioning strap 240 is dynamic (not shown).

When positioning strap 240 is deployed, mobile media device case 110 is configured to allow mobile media device case 110 to assume a first viewing or resting position. That is, dynamic positioning strap 240 forms a kickstand that allows a user to rest dynamic positioning strap 240 and either right side 115 or left side 116 of mobile media device case 110 against a flat surface. When positioning strap 240 and either right side 115 or left side 116 are resting against a flat surface, media device case 110 is at angle with the ground such that hands-free operating and viewing by the user are possible.

The multilayer back portion of media device enclosure 111 includes second case back layer 231 overlying first case back layer 230. The multilayer back portion of media device enclosure 111 additionally includes a camera well opening 232 and thereby allowing the camera of mobile media device 201 (FIG. 2) to function (i.e., the opening provide a hole for the lens of the camera to peek out of mobile media device case 110).

In many embodiments, second case back layer 231 and first case back layer 230 can form a positioning strap cavity 235 (FIG. 2) between them, which is configured to receive at least a portion of positioning strap 240. Second case back layer 231 additionally includes a positioning strap opening 234 that allows positioning strap 240 to perform to be deployed.

As previously described, positioning strap 240 can be configured to move between a non-deployed state and a deployed state, as shown in FIG. 4. Positioning strap 240 and back side 318 can be configured such that when positioning strap 240 is in the non-deployed state, edges 471, 472, and 474 can be abutting back side 318.

Positioning strap 240 and back side 318 can be configured such that when positioning strap 240 is in the deployed state, positioning strap 240 is in a curvilinear position such that at least part of edge 471 and at least part edge 472 are abutting back side 318 and at least part of edge 473 and at least part of edge 474 are spaced apart from back side 318.

Positioning strap 240 can be further configured to move between the non-deployed state and the deployed state when a force along axis 441 is applied to edge 473 and/or 474. For example, mobile media device case 110 is configured such that when a force along axis 441 is applied to positioning strap 240, positioning strap 240 is configured to deform in a substantially perpendicular direction away from first case back layer 230, edge 471 is configured to abut an edge of positioning strap opening 234, and edge 472 is configured to abut an edge of positioning strap opening 234.

First elastic securing portion 445 and second elastic securing portion 447 are configured to be in a non-flexed position when positioning strap 240 is in the non-deployed state. First elastic securing portion 445 and second elastic securing portion 447 are configured to be in a flexed position when the positioning strap is in the deployed position.

Figure 5:
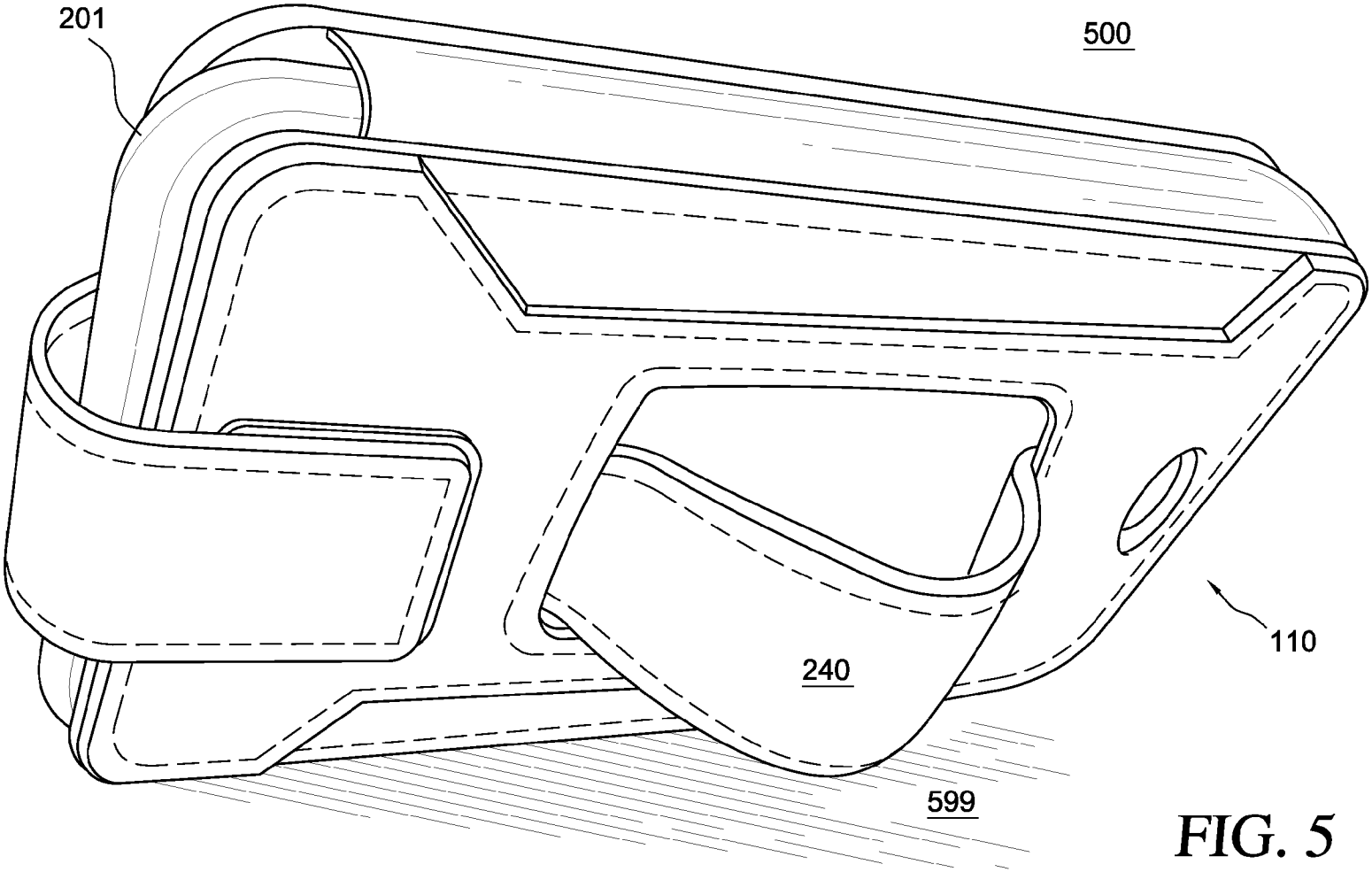
FIG. 5 is a rear perspective view illustrating the mobile media case of FIG. 1 with the positioning strap of FIG. 2 deployed, according to the first embodiment.

FIGS. 5-8 illustrate multiple views of an embodiment of media device case 110 in the dynamic or deployed state and resting against a flat surface 599. FIG. 5 is a rear perspective view illustrating the media device case 110. In FIG. 5, positioning strap 240 in a deployed state. Mobile media device case 110 is holding mobile media device 201, positioned in a landscape viewing format, and resting against a flat surface 599.

Figure 6:
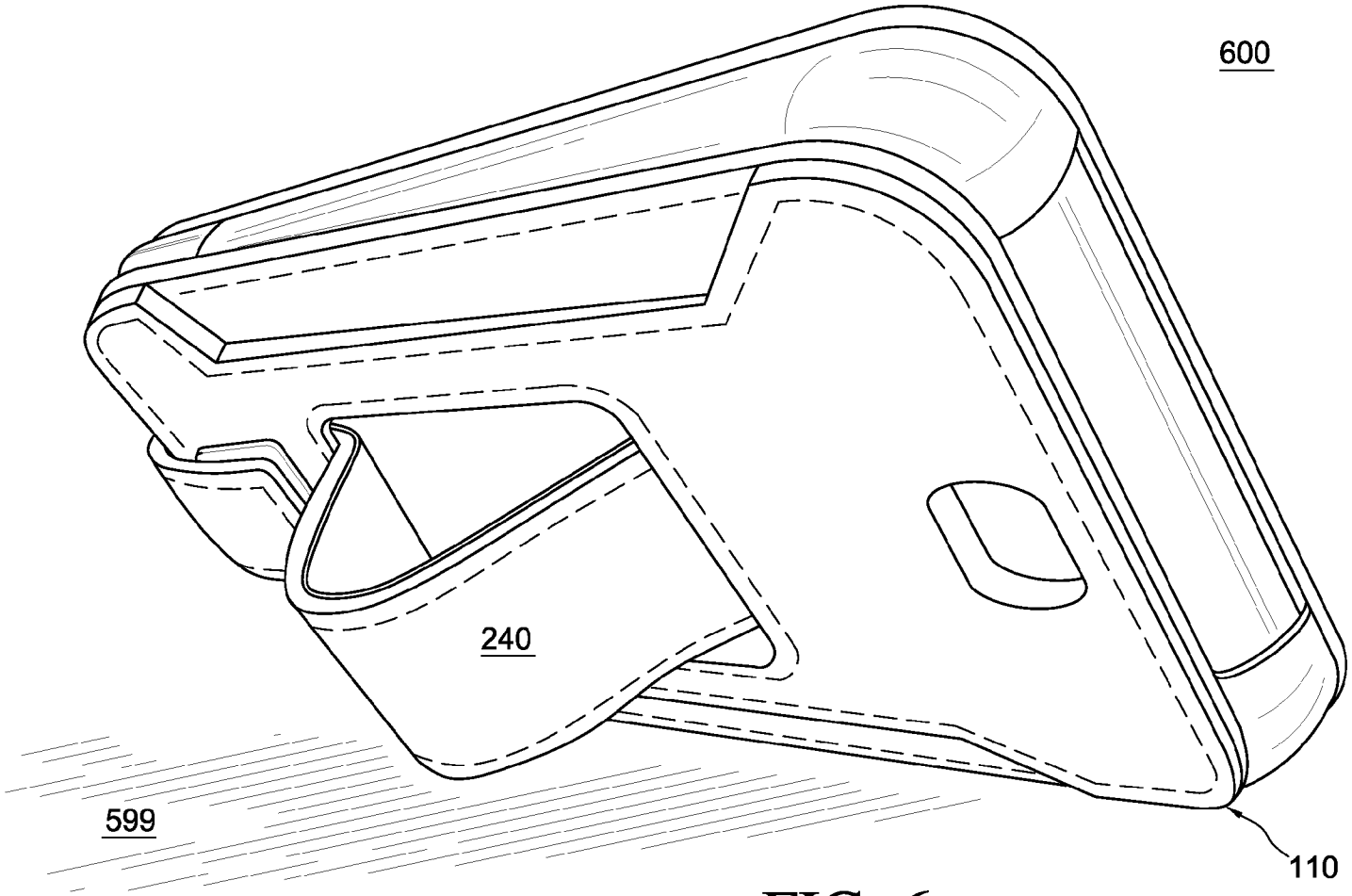
FIG. 6 is another rear perspective view illustrating the mobile media case of FIG. 1 with the positioning strap of FIG. 2 deployed, according to the first embodiment.

FIG. 6 is another rear perspective view illustrating the media device case 110. In FIG. 6, positioning strap 240 is in a deployed position. Mobile media device case 110 is also positioned in a landscape viewing format, and resting against a flat surface.

Figure 7:
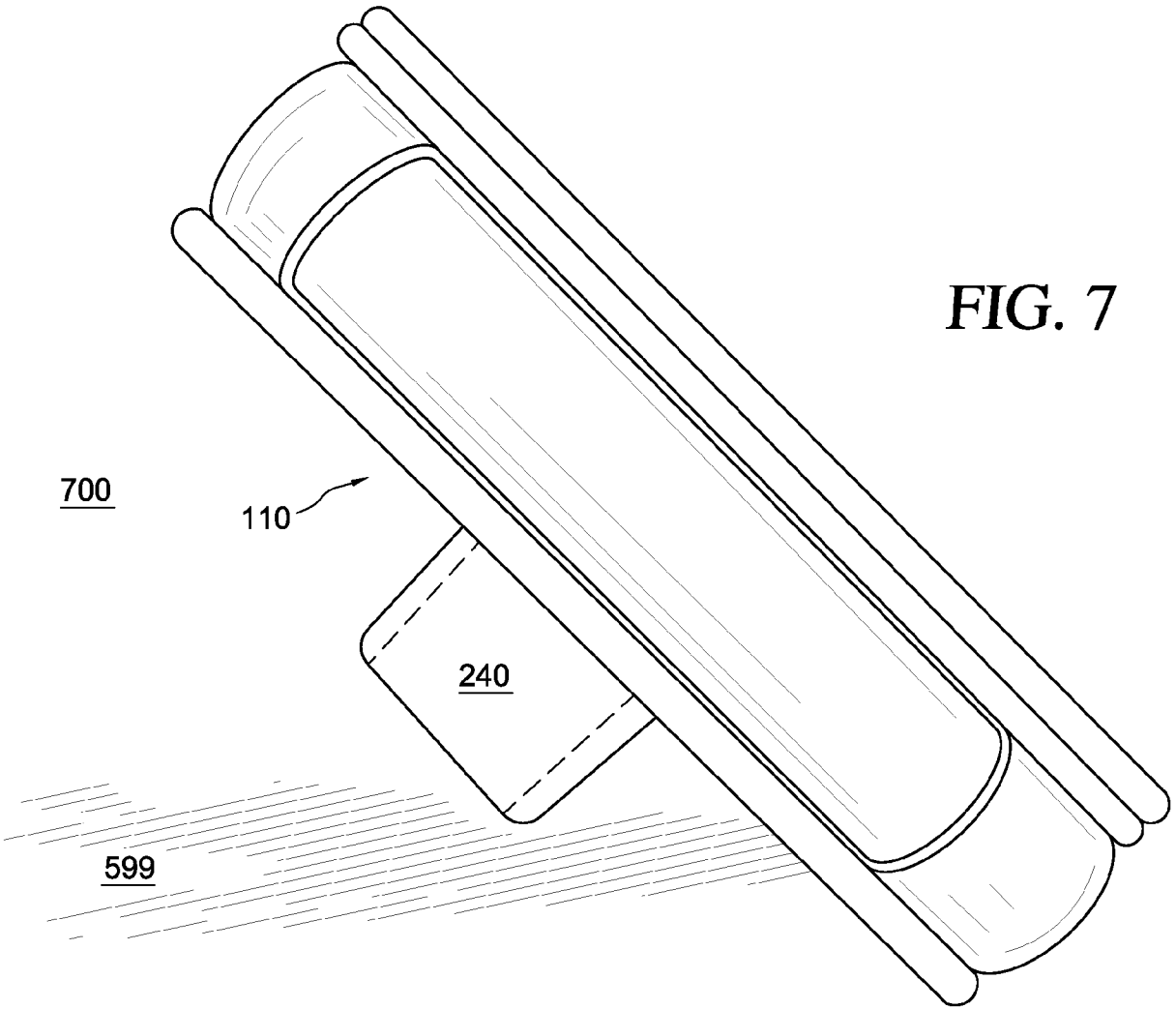
FIG. 7 is a left-side view illustrating the mobile media device case of FIG. 1 with the positioning strap of FIG. 2 deployed, according to the first embodiment.

FIG. 7 is a left-side view illustrating the mobile media device case 110. In FIG. 7, positioning strap 240 is in a deployed position. Mobile media device case 110 is also positioned in a landscape viewing format, and resting against a flat surface.

Figure 8:
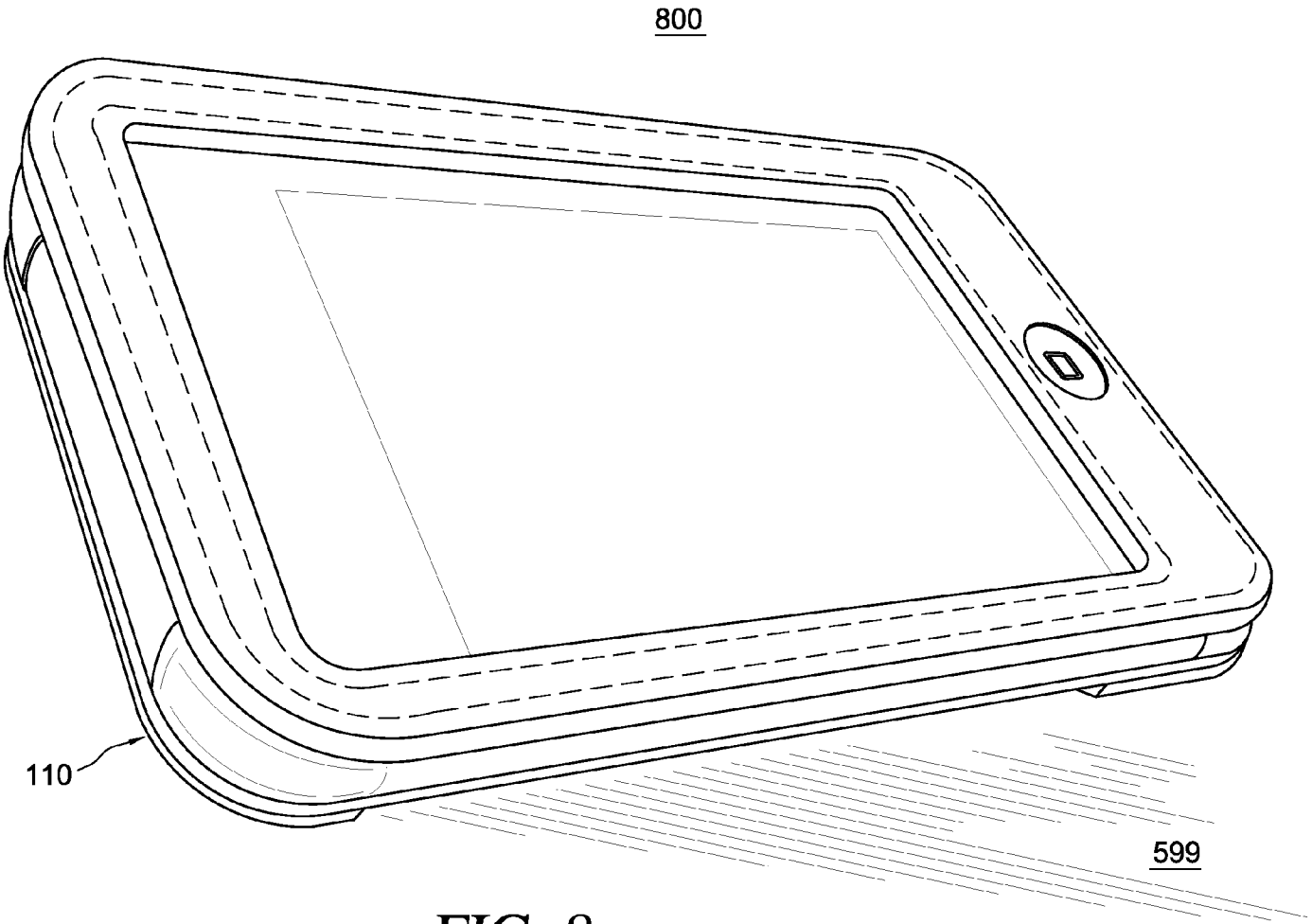
FIG. 8 is another front perspective view illustrating the mobile media case of FIG. 1, according to the first embodiment.

FIG. 8 is a front perspective view illustrating mobile media device case 110. In FIG. 8, positioning strap 240 in a deployed state. Mobile media device case 110 is holding mobile media device 201, positioned in a landscape viewing format, and resting against a flat surface 599.

Figure 9:
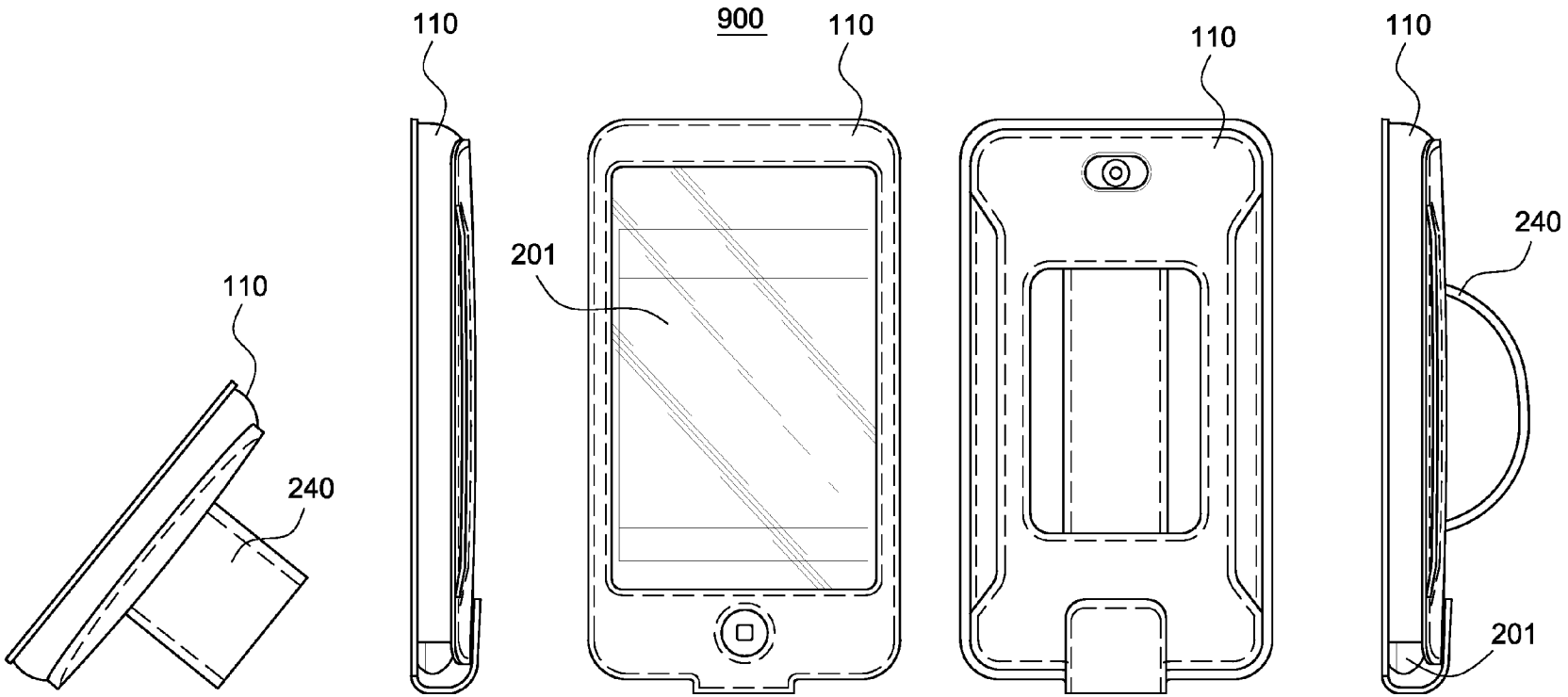
FIG. 9 illustrates additional views of embodiments the mobile media case of FIG. 1, according to the first embodiment.

FIG. 9 illustrates additional views of an embodiment of the mobile media device cases 110. In FIG. 9, some of the views include positioning strap in a deployed position, and some of the views include a positioning strap in the non-deployed position.

Figure 10:
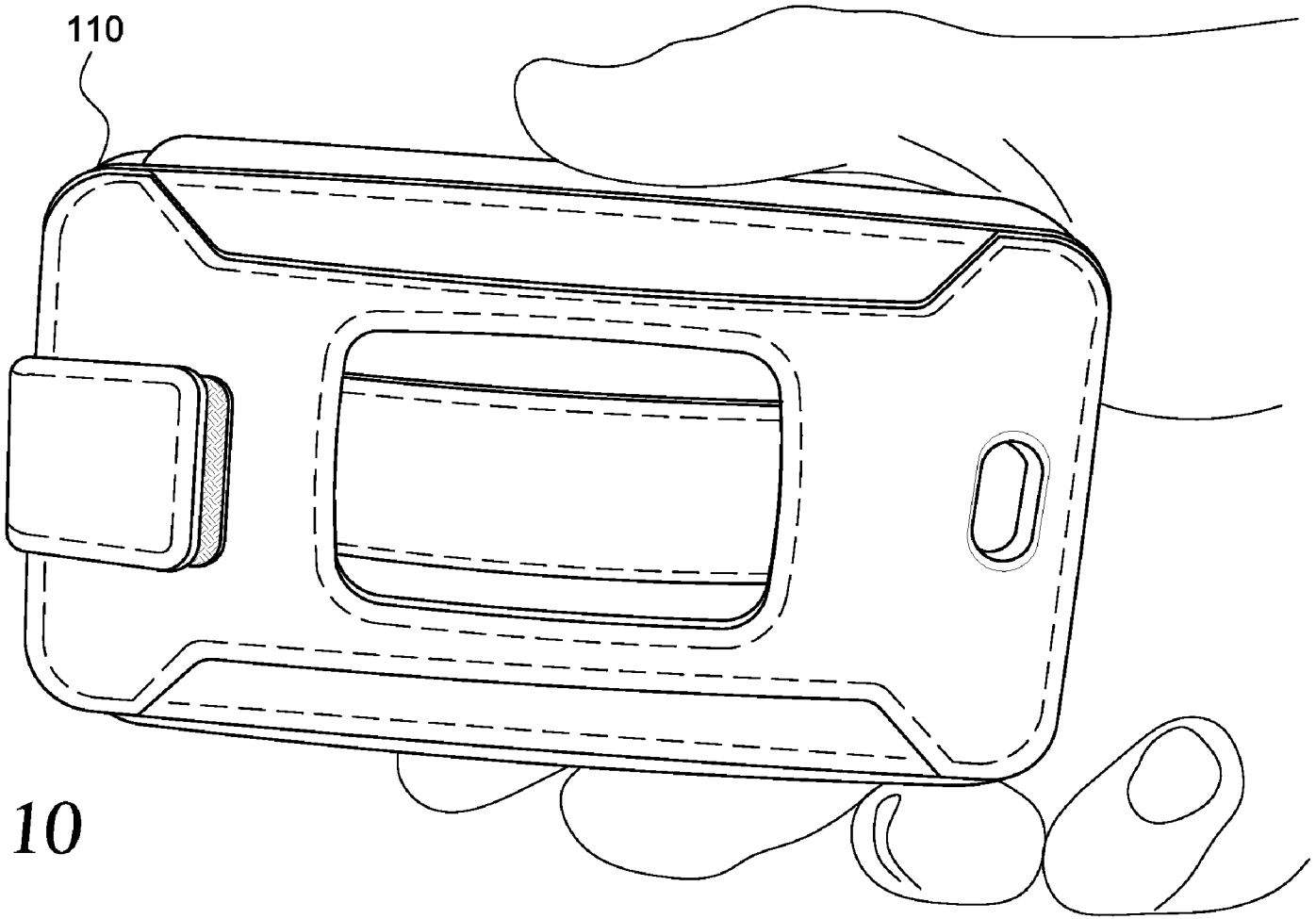
FIG. 10 is a rear view illustrating the mobile media case of FIG. 1 with the positioning strap of FIG. 2 not deployed, according to the first embodiment.
Figure 11:
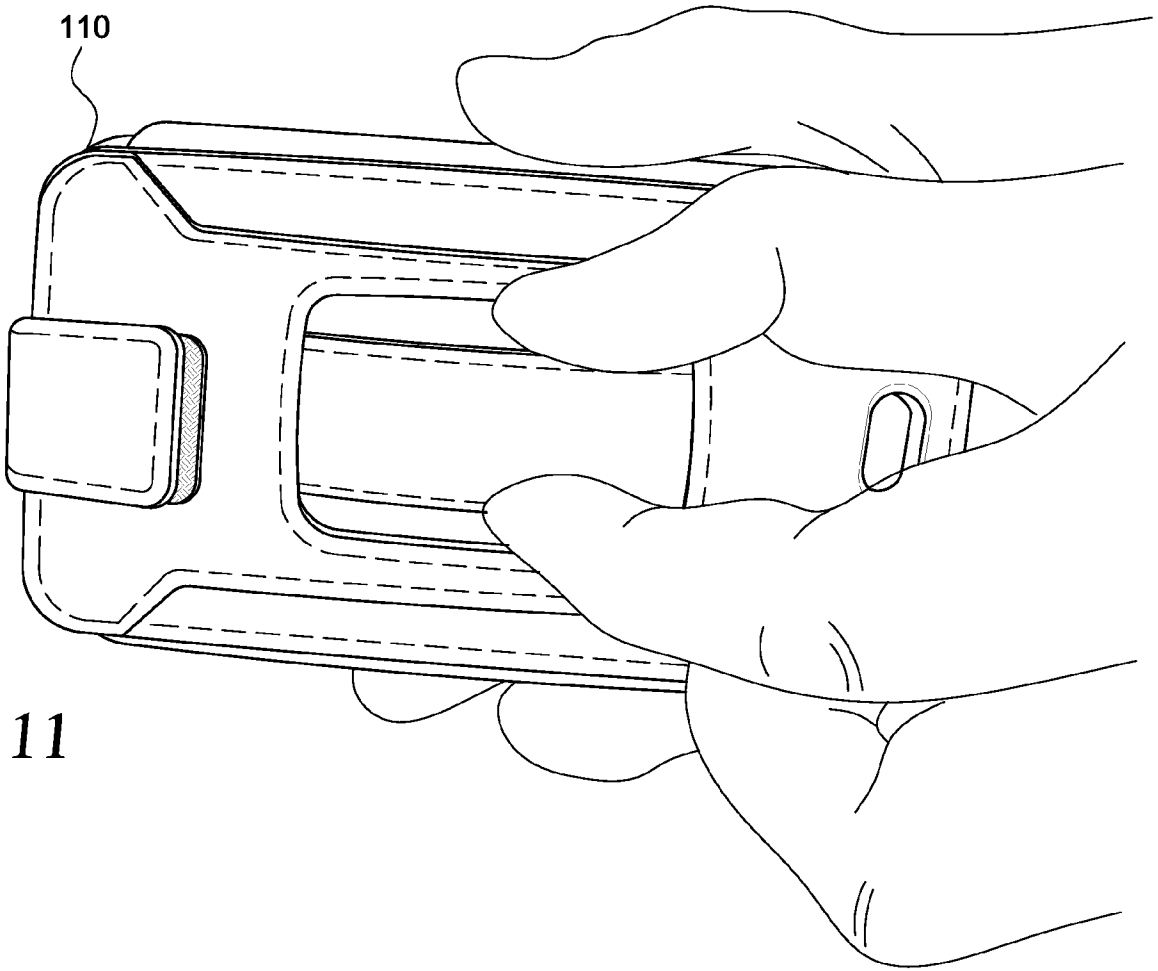
FIG. 11 is a rear view illustrating the mobile media case of FIG. 1 during deployment of the positioning strap of FIG. 2, according to the first embodiment.
Figure 12:
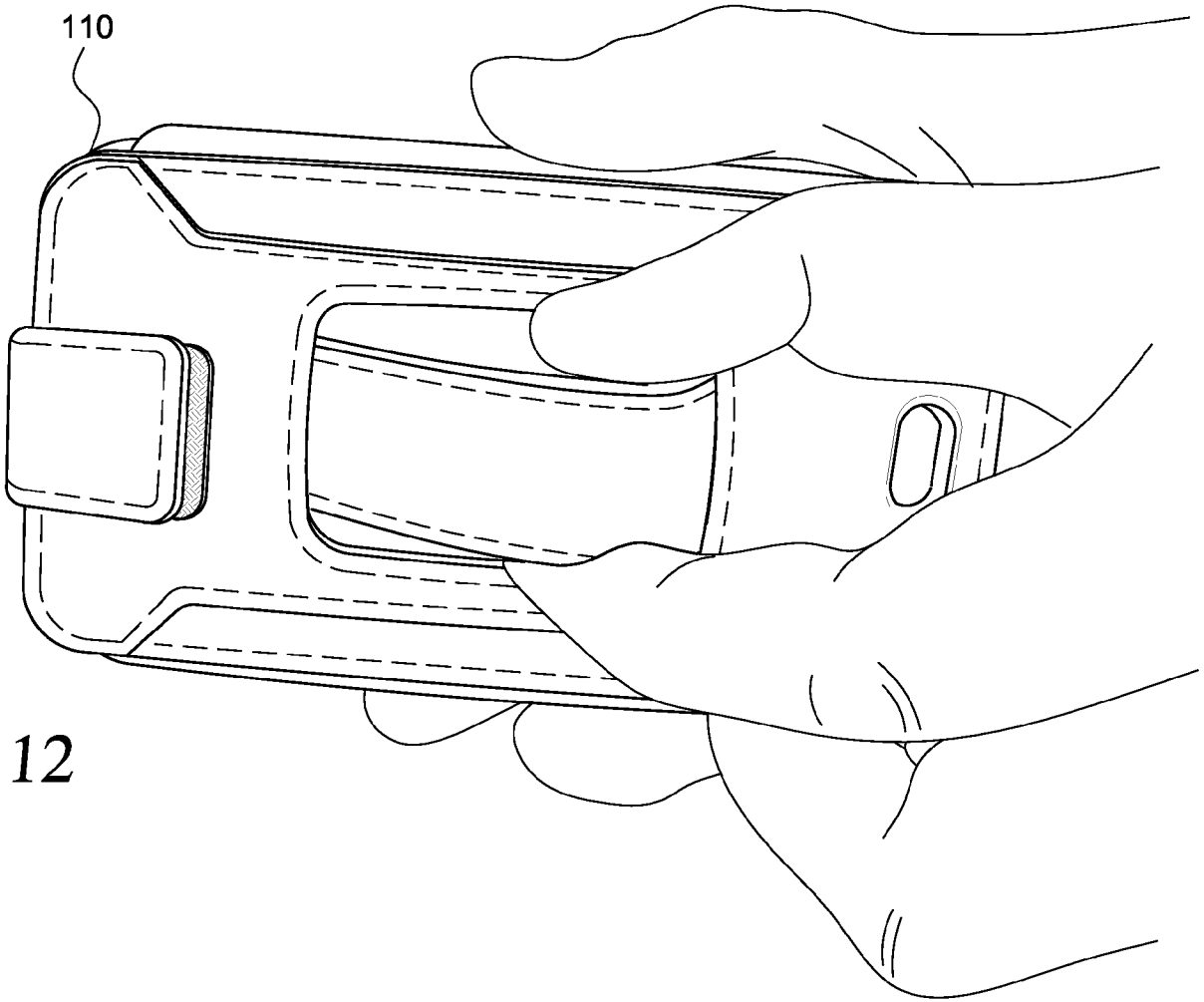
FIG. 12 is another rear view illustrating the mobile media case of FIG. 1 during deployment of the positioning strap of FIG. 2, according to the first embodiment.
Figure 13:
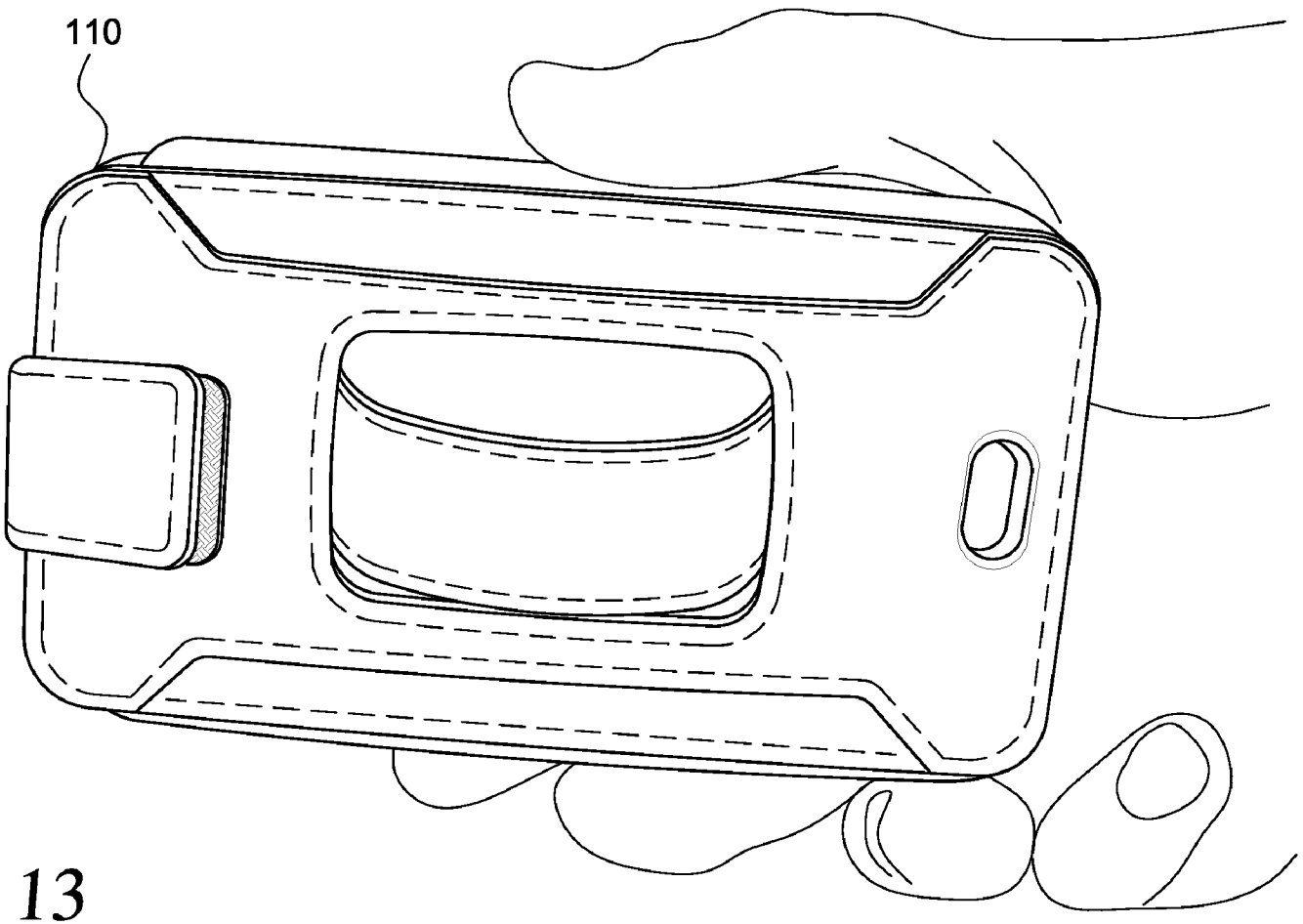
FIG. 13 is a rear view illustrating the mobile media case of FIG. 1 after deployment of the positioning strap of FIG. 2, according to the first embodiment.

FIGS. 10-14 illustrate a method of using a media case, according to an embodiment. Specifically, FIGS. 10-13 provide illustrations of the activities of method 1400. FIG. 10 is a rear view illustrating mobile media device case 110 with positioning strap 240. FIG. 11 is a rear view illustrating mobile media device case 110 during deployment of positioning strap 240. FIG. 12 is another rear view illustrating mobile media device case 110 during deployment of positioning strap 240. FIG. 13 is a rear view illustrating mobile media device case 110 after deployment of the positioning strap 240.

Figure 14:
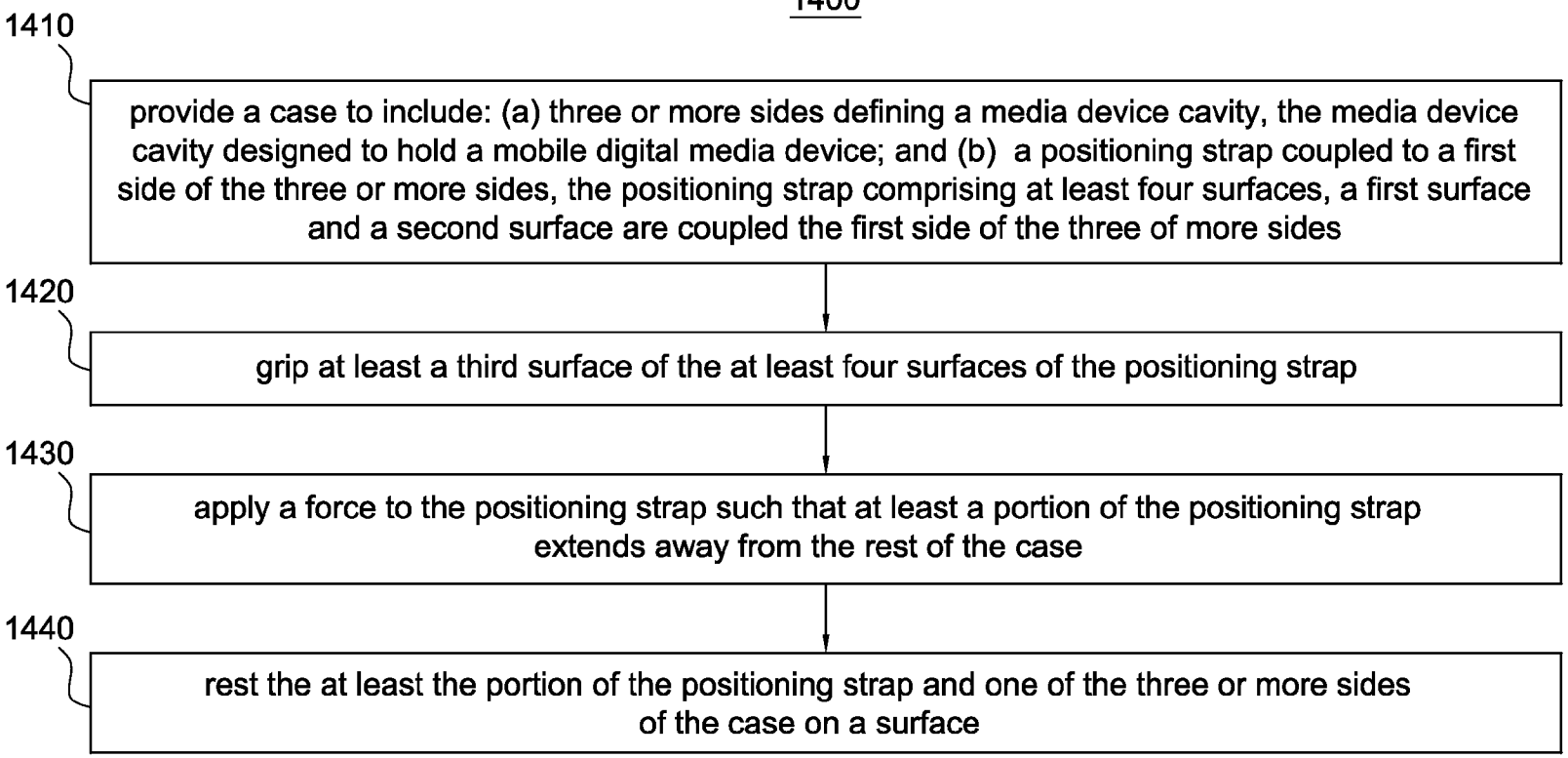
FIG. 14 is a flow diagram illustrating a method of using a mobile media device case, according to the first embodiment.

FIG. 14 illustrates a flow chart of a method 1400 for an embodiment of using a case with an electrical device. Method 1400 is merely exemplary and is not limited to the embodiments presented herein. Method 1400 can be employed in many different embodiments or examples not specifically depicted or described herein. In some embodiments, the activities, the procedures, and/or the processes of method 1400 can be performed in the order presented. In other embodiments, the activities, the procedures, and/or the processes of the method 1400 can be performed in any other suitable order. In still other embodiments, one or more of the activities, the procedures, and/or the processes in method 1400 can be combined or skipped.

Method 1400 includes an activity 1410 of providing a case to include: (a) three or more sides defining a media device cavity, the media device cavity configured to holding a mobile media device; and (b) a positioning strap coupled to a first side of the three or more sides, the positioning strap comprising at least four surfaces, a first surface and a second surface are coupled the first side of the three of more sides.

In some examples, the case can be similar to mobile media device case 110 of FIGS. 1-13. The three or more sides can be similar or identical to right side 115, left side 116, the bottom side of mobile media device case 110, the front side of mobile media device case 110, and/or the back side of mobile media device case 110, as illustrated in FIGS. 1-13. The positioning strap can be similar or identical to positioning strap 240 of FIG. 2.

Method 1400 continues with an activity 1420 of gripping at least a third surface of the at least four surfaces of the positioning strap. In some examples, the gripping of the at least the third surface of the at least four surfaces of the positioning strap can be similar or identical to the gripping of the positioning strap as illustrated in FIG. 11.

Subsequently, method 1400 includes an activity 1430 of applying a force to the positioning strap such that at least a portion of the positioning strap extends away from the rest of the case. In some examples, the force can be at least partially applied along the direction indicated by dynamic movement axis 441 (FIG. 4). In some examples, the applying of the force to the positioning strap can be similar to the applying of a force to the positioning strap as illustrated in FIG. 12. In some examples, after applying the force, at least a portion of the positioning strap is extended away from the rest of the case, as illustrated in FIG. 12.

Method 1400 continues with an activity 1440 of resting the at least the portion of the positioning strap and one of the three or more sides of the case on a surface. In some examples, the resting of at least the portion of the positioning strap and one of the three or more sides of the case on a surface can be similar to the resting of the portion of the positioning strap and one of the three or more sides of the case on a surface as illustrated in FIGS. 5-8

Although the invention has been described with reference to specific embodiments, it will be understood by those skilled in the art that various changes may be made without departing from the scope of the invention. Accordingly, the disclosure of embodiments is intended to be illustrative of the scope of the invention and is not intended to be limiting. It is intended that the scope of the invention shall be limited only to the extent required by the appended claims. To one of ordinary skill in the art, it will be readily apparent that the devices and method discussed herein may be implemented in a variety of embodiments, and that the foregoing discussion of certain of these embodiments does not necessarily represent a complete description of all possible embodiments. Rather, the detailed description of the drawings, and the drawings themselves, disclose at least one preferred embodiment, and may disclose alternative embodiments.

All elements claimed in any particular claim are essential to the embodiment claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are stated in such claim.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents

What is claimed is:

1. A mobile media device case, the mobile media device case comprising:

an enclosure with a cavity, the cavity sized to contain a mobile media device therein, the enclosure further having:

a top side;

a bottom side, the bottom side configured to receive the mobile media device;

a front side, the front side is configured to allow visual and tactile access to the mobile media device when the mobile media device is in the cavity; and a back side, the back side having:

a first case back layer configured to be in mechanical communication with the top side and the bottom side of the enclosure; and a second case back layer including a positioning strap opening; and a positioning strap having:

a first positioning strap edge, the first positioning strap edge elastically coupled between the first case back layer and the second case back layer;

a second positioning strap edge, the second positioning strap edge fixedly coupled between the first case back layer and the second case back layer;

a top surface located between the first positioning strap edge and the second positioning strap edge; and a bottom surface opposite the top surface and located between the first positioning strap edge and the second positioning strap edge, wherein:

two or more positioning strap openings are located between an edge of the first case back layer of the back side and an edge of the second case back layer of the back side; and the enclosure is configured such that when force is applied to the positioning strap, the positioning strap is configured to deform in a substantially perpendicular direction away from the first case back layer, the first positioning strap edge of the positioning strap is configured to abut an edge of a first one of the two or more positioning strap opening, and the second positioning strap edge of the positioning strap is configured to abut an edge of a second one of the two or more positioning strap opening.

2. The mobile media device case of claim 1, further comprising:

a securing strap coupled to the top side and including a distal end, wherein:

the back side of the enclosure includes a securing strap receiving layer, and the distal end of the securing strap is configured to removably couple to the securing strap receiving layer to secure the mobile media device in the cavity.

3. The mobile media device case of claim 2, wherein:

the securing strap receiving layer is coupled to the second case back layer of the back side of the enclosure.

4. The mobile media device case of claim 1, wherein:

the back side of the enclosure further has a camera well opening.

5. The mobile media device case of claim 1, further comprising:

a first elastic securing portion coupled to the first positioning strap edge of the positioning strap, wherein:

the positioning strap is secured between the first case back layer and the second case back layer using the first elastic securing portion.

6. The mobile media device case of claim 5, further comprising:

a second elastic securing portion coupled to the second positioning strap edge of the positioning strap, wherein:

the positioning strap is secured between the first case back layer and the second case back layer using the second elastic securing portion.

7. The mobile media device case of claim 1, wherein the enclosure is configured such that when a second force is applied to the positioning strap, the positioning strip is configured to deform back in a position abutting and at least partially parallel to the back side of the enclosure.

8. The mobile media device case of claim 1, wherein:

the front side of the enclosure comprises a transparent film;

the transparent film is configured to allow the visual and the tactile access to the mobile media device when the mobile media device is in the cavity.

9. The mobile media device case of claim 1, wherein the positioning strap is configured to deform in a curvealinearly manner when the force is applied.

10. A mobile media device case to hold a mobile media device, the mobile media device case comprising:

three or more sides defining a media device cavity, the media device cavity configured to hold the mobile media device;

a positioning strap coupled to a first side of the three or more sides, the positioning strap comprising at least four surfaces;

a first elastic securing portion coupled to a first surface of the at least four surfaces of the positioning strap and the first side of the three or more sides; and a second elastic securing portion coupled to a second surface of the at least four surfaces of the positioning strap and the first side of the three or more sides;

wherein:

the positioning strap is configured to move between a non-deployed state and a deployed state;

the positioning strap and the first side of the three or more sides are configured such that when the positioning strap is in the non-deployed state, at least part of a third surface of the at least four surfaces of the positioning strap is abutting the first side of the three of more sides; and the positioning strap and the first side of the three or more sides are configured such that when the positioning strap is in the deployed state, the positioning strap is in a curvilinear position such that at least part of the first surface of the at least four surfaces of the positioning strap and at least part of the second surface of the at least four surfaces of the positioning strap are abutting the first side of the three or more sides and at least part of a third surface and at least part of a fourth surface of the at least four surfaces of the positioning strap are spaced apart from the first side of the three or more sides.

11. The mobile media device case of claim 10, wherein:

the positioning strap is configured to move between the non-deployed state and the deployed state when a force at least partially perpendicular to the first side of the three or more side is applied to the positioning strap.

12. The mobile media device case of claim 10, wherein:

the first elastic securing portion is configured to be in a non-flexed position when the positioning strap is in the non-deployed state; and the first elastic securing portion is configured to be in a flexed position when the positioning strap is in the deployed position.

13. The mobile media device case of claim 12, wherein:

the second elastic securing portion is configured to be in a non-flexed position when the positioning strap is in the non-deployed state; and the second elastic securing portion is configured to be in a flexed position when the positioning strap is in the deployed position.

14. The mobile media device case of claim 12, wherein:

the first elastic securing portion has a substantially hourglass shape when in the flexed position; and the second elastic securing portion has a substantially hourglass shape when in the flexed position.

15. The mobile media device case of claim 12, wherein:

the first side of the three or more sides comprises:

a first case back layer; and a second case back layer coupled to the first case back layer.

16. The mobile media device case of claim 15, wherein:

the first elastic securing potion is coupled to the first side of the three or more sides between the first case back layer and the second case back layer; and the second elastic securing potion is coupled to the first side of the three or more sides between the first case back layer and the second case back layer.

17. The mobile media device case of claim 15, wherein:

the positioning strap and the first side of the three or more sides are configured such that when the positioning strap is in the non-deployed state, at least part of the positioning strap, the first elastic securing portion and the second elastic securing portion are located between the first case back layer and the second case back layer.

18. The mobile media device case of claim 17, wherein:

the positioning strap and the first side of the three or more sides are configured such that when the positioning strap is in the deployed state, at least part of the first elastic securing portion and at least part of the second elastic securing portion are located between the first case back layer and the second case back layer and the at least part of the positioning strap is located exterior to the three or more sides.

19. A method of using a media case, the method comprising:

providing the media case to include:

three or more sides defining a media cavity, the media cavity configured to contain a mobile media device;

a positioning strap, the positioning strap coupled to a first side of the three or more sides, the positioning strap having at least four edges, the first edge of the at least four edges and the second edge of the at least four edges of the positioning strap are elastically coupled to the first side of the three or more sides;

gripping at least one of a third edge of the at least four edges of the positioning strap or a fourth edge of the at least four edges of the positioning strap;

applying a force to the positioning strap such that at least a portion of the positioning strap extends away from the first side of the three or more sides; and resting the at least a portion of the positioning strap and a second side of the three or more sides on a surface.

20. The method of claim 19, wherein:

the first side of the three of more side comprises:

a first case back layer; and a second case back layer coupled to the first case back layer, two or more positioning strap openings are located between an edge of the first case back layer and an edge of the second case back layer;

the first edge of the at least four edges of the positioning strap and the second edge of the at least four edges of the positioning strap are elastically coupled between the first case back layer and the second case back layer; and applying the force to the positioning strap comprises:

applying the force to the positioning strap such that the positioning strap exits the two or more positioning strap opening when the force is applied.

* * * * *